US009661943B1

(12) United States Patent
Pegues

(10) Patent No.: US 9,661,943 B1
(45) Date of Patent: May 30, 2017

(54) FLOWER WHEEL SYSTEM

(71) Applicant: Estella Pegues, Chicago, IL (US)

(72) Inventor: Estella Pegues, Chicago, IL (US)

( * ) Notice: Subject to any disclaimer, the term of this patent is extended or adjusted under 35 U.S.C. 154(b) by 201 days.

(21) Appl. No.: 14/639,941

(22) Filed: Mar. 5, 2015

Related U.S. Application Data

(60) Provisional application No. 62/003,177, filed on May 27, 2014.

(51) Int. Cl.
*G09B 25/08* (2006.01)
*A47G 7/02* (2006.01)

(52) U.S. Cl.
CPC ..... *A47G 7/02* (2013.01)

(58) Field of Classification Search
USPC ..... 434/81, 82, 93, 95, 101; 428/24; 156/61, 63; 206/423
See application file for complete search history.

(56) References Cited

U.S. PATENT DOCUMENTS 1,630,082 A * 5/1927 Graham ..... A63H 33/04 206/423
3,525,660 A * 8/1970 Kerrigan ..... A41G 1/00 156/61
4,525,394 A * 6/1985 Standley ..... A41G 1/00 156/61
4,600,612 A * 7/1986 Litwin ..... A41G 1/00 156/63
4,708,893 A 11/1987 Little et al.
4,892,515 A 1/1990 Stiegeler
5,108,800 A * 4/1992 Koo ..... A41G 1/00 156/61
5,145,730 A * 9/1992 Cheng ..... A41G 1/00 156/61
5,300,010 A * 4/1994 Eddins ..... A41G 1/02 428/26
5,314,730 A 5/1994 Flores
5,409,383 A * 4/1995 Mannino ..... A45C 15/00 434/408
5,562,927 A * 10/1996 Masuda ..... C11D 13/16 249/115
5,955,158 A * 9/1999 Wilkins ..... A41G 1/00 156/61
6,149,437 A * 11/2000 Corliss ..... B44C 3/06 139/29
7,641,464 B2 * 1/2010 Griffin ..... B28B 1/02 425/263
8,308,483 B2 * 11/2012 Hume ..... G09B 11/00 434/81
8,864,487 B2 * 10/2014 Bailey ..... B28B 1/025 269/203
2008/0003545 A1 * 1/2008 Mark-Hummel ..... G09B 11/00 434/85
2014/0370467 A1 * 12/2014 Stevenson ..... A01G 5/04 434/81

* cited by examiner

*Primary Examiner* — Kurt Fernstrom
(74) *Attorney, Agent, or Firm* — RG Patent Consulting, LLC; Rachel Gilboy

(57) ABSTRACT

A specially designed crafting tool having a base, a spinning wheel and tools, with which to create beautiful faux flowers from spools of wire-edged ribbon and wire to provide craft enthusiasts and others a practical decorating tool with which to create fancy faux flowers ideal for a variety of uses.

16 Claims, 5 Drawing Sheets

FLOWER WHEEL SYSTEM

CROSS-REFERENCE TO RELATED APPLICATION

The present application is related to and claims priority from prior provisional application Ser. No. 62/003,177, filed May 27, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of methods and devices for making ribbon-flowers and more specifically relates to a flower wheel system.

2. Description of the Related Art

An extremely simple and beautiful way in which to accentuate any home or office decor is by utilizing flowers. Whether a glass vase filled with fresh roses, a dramatic floral arrangement comprised of lilies, gardenias and babies breath, or a colorful clay pot full of daisies, flowers offer a simple means of adding a splash of lively color and beauty to any room environment. While fresh flowers offer a lovely and fragrant means of enhancing a room's atmosphere, many consumers find that faux flowers offer a long-lasting and more affordable alternative. Faux flowers last year-round, maintaining their vibrant color and shape from one season to the next. Manufactured of fancy silk or even malleable plastic material, faux flowers can be used to adorn a holiday table or add a simple elegant touch to a night stand, desk or bureau.

Many people would like to be able to use their crafting talents to make their own faux flowers. Homemade faux flowers would be less expensive to make than purchasing them, and would give the home owner the ability to design and create their own faux flowers. A suitable solution is desirable.

Various attempts have been made to solve the above-mentioned problems such as those found in U.S. Pat. No. 4,708,893 to John D. Little, et al; U.S. Pat. No. 4,892,515 to Pamela S. Stiegeler; and U.S. Pat. No. 5,314,730 to Erlinda V. Flores. This art is representative of methods and means for making ribbon-flowers. None of the above inventions and patents, taken either singly or in combination, is seen to describe the invention as claimed.

Ideally, a flower wheel system should provide a user with the ability to create their own floral designs using their own materials and, yet would operate reliably and be manufactured at a modest expense. Thus, a need exists for a reliable flower wheel system to avoid the above-mentioned problems.

BRIEF SUMMARY OF THE INVENTION

In view of the foregoing disadvantages inherent in the known methods and devices for making ribbon-flowers art, the present invention provides a novel flower wheel system. The general purpose of the present invention, which will be described subsequently in greater detail, is to provide a specially designed crafting tool with which to create beautiful faux flowers from spools of wire-edged ribbon and floral reinforcement to provide craft enthusiasts and others a practical decorating tool with which to create fancy faux flowers ideal for a variety of uses.

A flower wheel system is disclosed herein, in a preferred embodiment, comprising a flower-wheel-assembly, a dowel, and at least one pair of tools. The flower-wheel-assembly comprises in structural arrangement a base, a drawer, and a spinning-wheel having a dowel-insert.

The base, having a flat-bottom-surface is able to rest evenly and stable on a planer surface and comprises a circular-center-opening with a protruding mount in the center of the opening for containing the spinning-wheel when in use. The flat-bottom-surface is covered with rubber material to provide a gripping means for the flower-wheel assembly when in use while providing protection for the planer surface, comprising a piece of furniture.

The base further comprises polished wooden material in preferred embodiments dimensions measuring approximately two inches in height and approximately seven and three quarters inches in diameter useful for providing stability for the flower-wheel-assembly when in use. A drawer-volume in the base comprises sufficient width and depth to contain the drawer when the drawer is inserted into the base.

The drawer, useful for storing the dowel and the pair of tools, is removably insertable into the drawer-volume of the base. The drawer, comprising a handle for opening and closing the drawer via a hand of a user, is sized to store the dowel and has sufficient storage clearance for the pair of tools when the flower-wheel system is not in use. The pair of tools comprises a ribbon-pick comprised of bendable light-weight metal material and a wire-pick also comprised of light-weight metal material.

The ribbon-pick comprises a paddle-shape having an overall length of approximately three and one-half inches with an upper-part measuring approximately one and one-half inches long and approximately one-half inch wide, and a lower-section comprising a length of approximately two inches and approximately one-eighth of an inch wide and terminating at a pointed-tip. The ribbon-pick is useful for manipulating ribbon-material used for creating faux flowers via the pointed-tip of the lower-section of the ribbon-pick in conjunction with the dowel.

The wire-pick comprises a tweezer-shape having a fulcrum-point and two curved-levers measuring approximately one-fourth of an in inch wide. Each of the curved-levers, extending out from the fulcrum-point approximately three inches in a biasing manner, is useful for manipulating wire-material used for creating faux flowers via applying pressure to the curved-levers to grip the wire-material using the wire-pick in conjunction with the dowel. The floral wire-material comprises different lengths as needed useful for reinforcing knotted ribbon-material in the vertical-slot by wrapping the wire-material around the dowel to secure the knotted ribbon-material depending on type of faux flower the user is crafting. The floral wire-material further can be used to secure the ribbon-material when the user measures ribbon-material out from the dowel and folds the ribbon-material back to the dowel by wrapping around ribbon-material depending on the type of faux flower the user is crafting.

The spinning-wheel having a dowel-insert, constructed of durable material, fits onto a protruding mount in the center of a circular-center-opening of the base located in a top of the base. The spinning-wheel comprising a diameter of approximately four and one-half inches and a height of approximately one inch is removably insertable onto the protruding mount in the center of the circular-center-opening of the base. The spinning-wheel further comprises a plurality of fingertip-groves equidistantly spaced around a top-surface of the spinning-wheel.

Each of the fingertip-groves radiates from the dowel-insert of the spinning-wheel to an outer-edge of the spinning-wheel. Each of the plurality of fingertip-grooves, are approximately three-sixteenths of an inch wide to accommodate the fingertips of the user, are useful for manipulating the spinning-wheel when the flower wheel system is in use as the user turns the spinning-wheel alternately clockwise and counter-clockwise during creation of the faux-flowers.

The dowel, having two insertion notches extending out from the lower side of the dowel, each comprising a length of approximately three-fourths of an inch The dowel, comprising an overall length of approximately four inches, is removably insertable into the dowel-insert of the spinning-wheel at an angle perpendicular to the spinning-wheel when the flower wheel system is in use. The dowel, constructed of light weight metal, is held in place via insertion notches as the dowel turns clockwise or counter-clockwise while the spinning-wheel is being turned clockwise or alternately counter-clockwise. The dowel further comprises a vertical-slot, comprising a length of approximately two and one-half inches useful for retaining a length of knotted/unknotted wire-edged-ribbon used to weave the faux-flowers.

The user is able to use the flower wheel system to create faux flowers by removing the dowel and the pair of tools from the drawer, inserting the dowel via insertion notches into the dowel-insert and use the pair of tools to fashion faux flower-making-materials into faux flowers via manipulating the spinning-wheel via the fingertip-grooves of the spinning-wheel with the fingertips of the user to turn the spinning-wheel in alternating clockwise or counter-clockwise directions as desired.

The present invention holds significant improvements and serves as a flower wheel system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, flower wheel system constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a method and means for making ribbon-flowers and more particularly to a flower wheel system, a specially designed crafting tool with which to create beautiful faux flowers from spools of wire-edged ribbon and floral wire support to provide craft enthusiasts and others a practical decorating tool with which to create fancy faux flowers ideal for a variety of uses.

Generally speaking, a flower wheel system is a device for creating faux flowers from ribbon material and supporting wire material. The flower wheel system comprises a base with an insertable spinning-wheel having fingertip-groves used for spinning the spinning-wheel in alternating clockwise and counter-clockwise directions with the fingertips of a user and to rotate an insertable dowel with a slot for containing the wire and ribbon material. The user is able to manipulate the wire material with a wire-pick and/or the ribbon material with a ribbon-pick as the faux flowers are being created.

Figure 1:
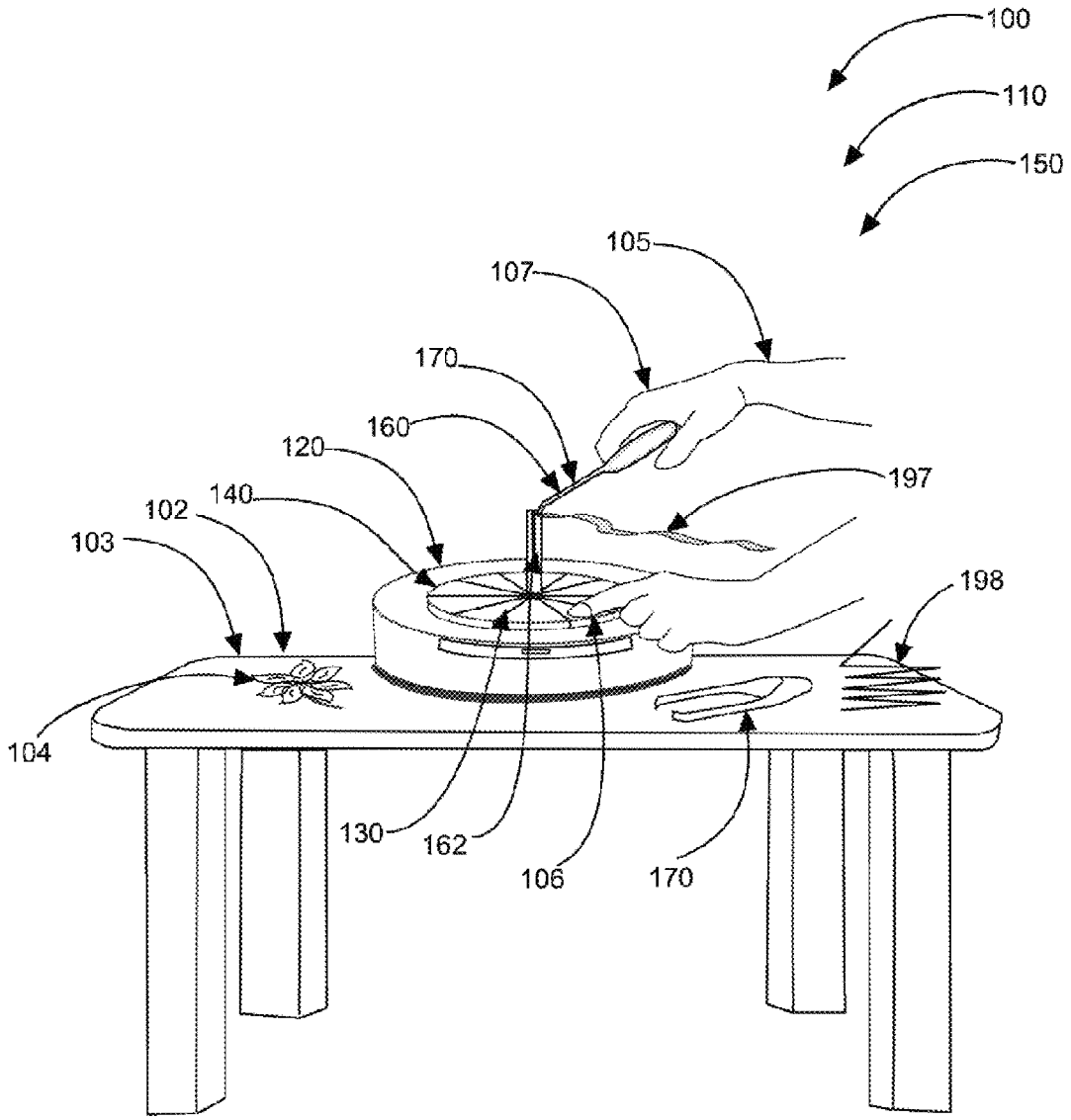
FIG. 1 shows a perspective view illustrating a flower wheel system in an in-use condition according to an embodiment of the present invention.

Referring to the drawings by numerals of reference there is shown in FIG. 1, a perspective view illustrating flower wheel system 100 in an in-use condition 150 according to an embodiment of the present invention.

Flower wheel system 100 comprises flower-wheel-assembly 110, dowel 160 having insertion notches 165, and at least one pair of tools 170. Flower-wheel-assembly 110 comprises in structural arrangement base 120, drawer 130, and spinning-wheel 140 having dowel-insert 162. Base 120, having flat-bottom-surface 122 to rest evenly and stable on planer surface 102, comprises circular-center-opening 124 having protruding mount 125 in the center of circular-center-opening 124 for containing spinning-wheel 140 when in use. Flat-bottom-surface 122 is covered with rubber material 123 to provide a gripping means for flower-wheel assembly 110 when in use while providing protection for planer surface 102, comprising piece of furniture 103. Other suitable materials may be used on flat-bottom-surface 122 to provide a gripping means for flower-wheel assembly 110 when in use while providing protection for planer surface 102.

A user 105 is able to use flower wheel system 100 to create faux flowers 104 by removing dowel 160 and pair of tools 170 from drawer 130, inserting dowel 160 via insertion notches 165 into dowel-insert 162 and use pair of tools 170 to fashion flower-making-materials into faux flowers 104 via manipulating spinning-wheel 140 via fingertip-grooves 142 of spinning-wheel 140 with fingertips 106 of user 105 to turn spinning-wheel 140 in alternating clockwise and counter-clockwise directions as desired.

Figure 2:
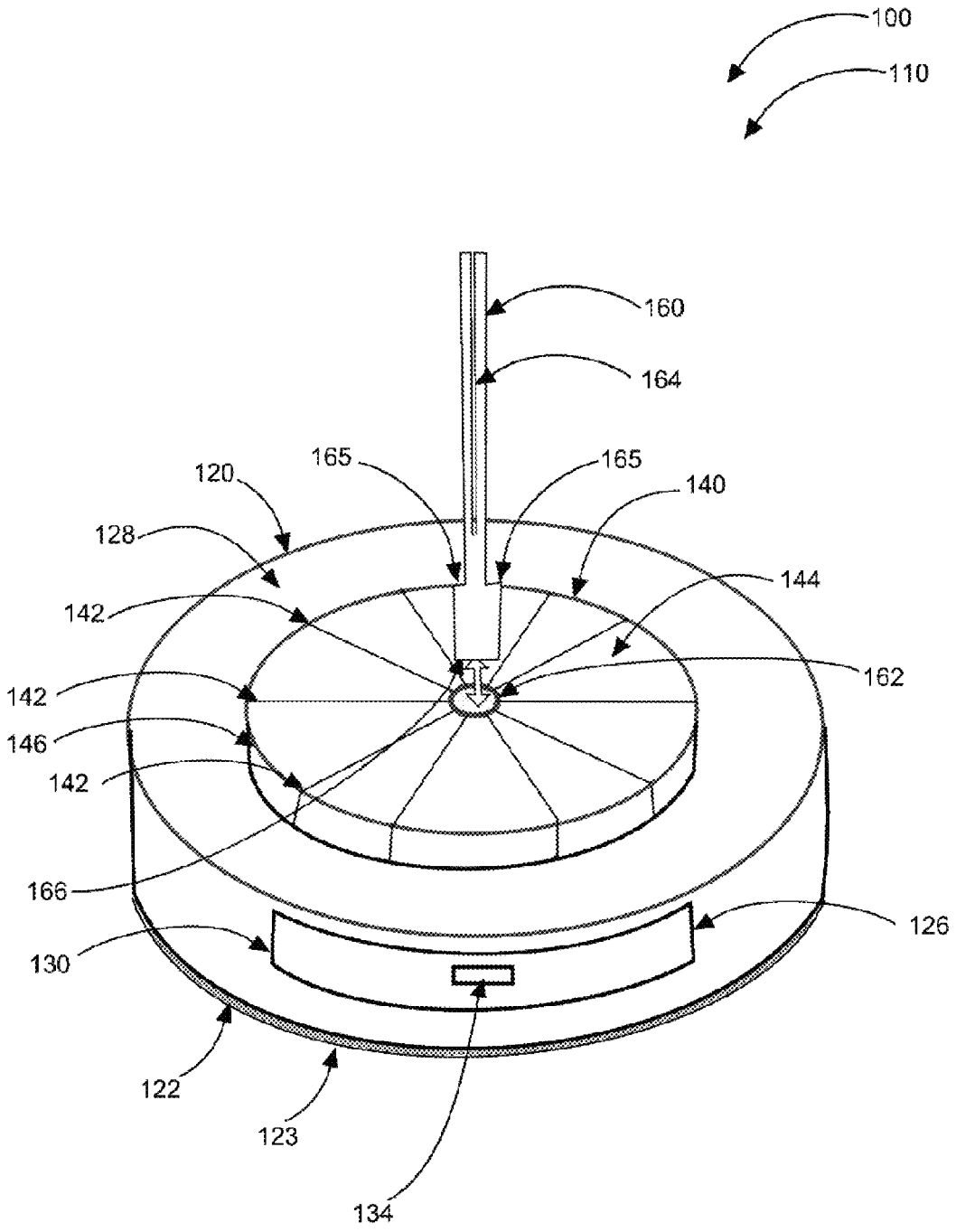
FIG. 2 is a perspective view illustrating a flower wheel system according to an embodiment of the present invention of FIG. 1.

Referring now to FIG. 2, a perspective view illustrating flower wheel system 100 according to an embodiment of the present invention of FIG. 1.

Base 120 may further comprise polished wooden material measuring approximately two inches in height and approximately seven and three quarters inches in diameter useful for providing stability for flower-wheel-assembly 110 when in use. Drawer-volume 126 of base 120 comprises sufficient width and depth to contain drawer 130 when drawer 130 is inserted into base 120. Base 120 may be manufactured in smaller and larger overall sizes using other suitable materials for base 120 to provide greater flexibility for user 105.

Figure 3:
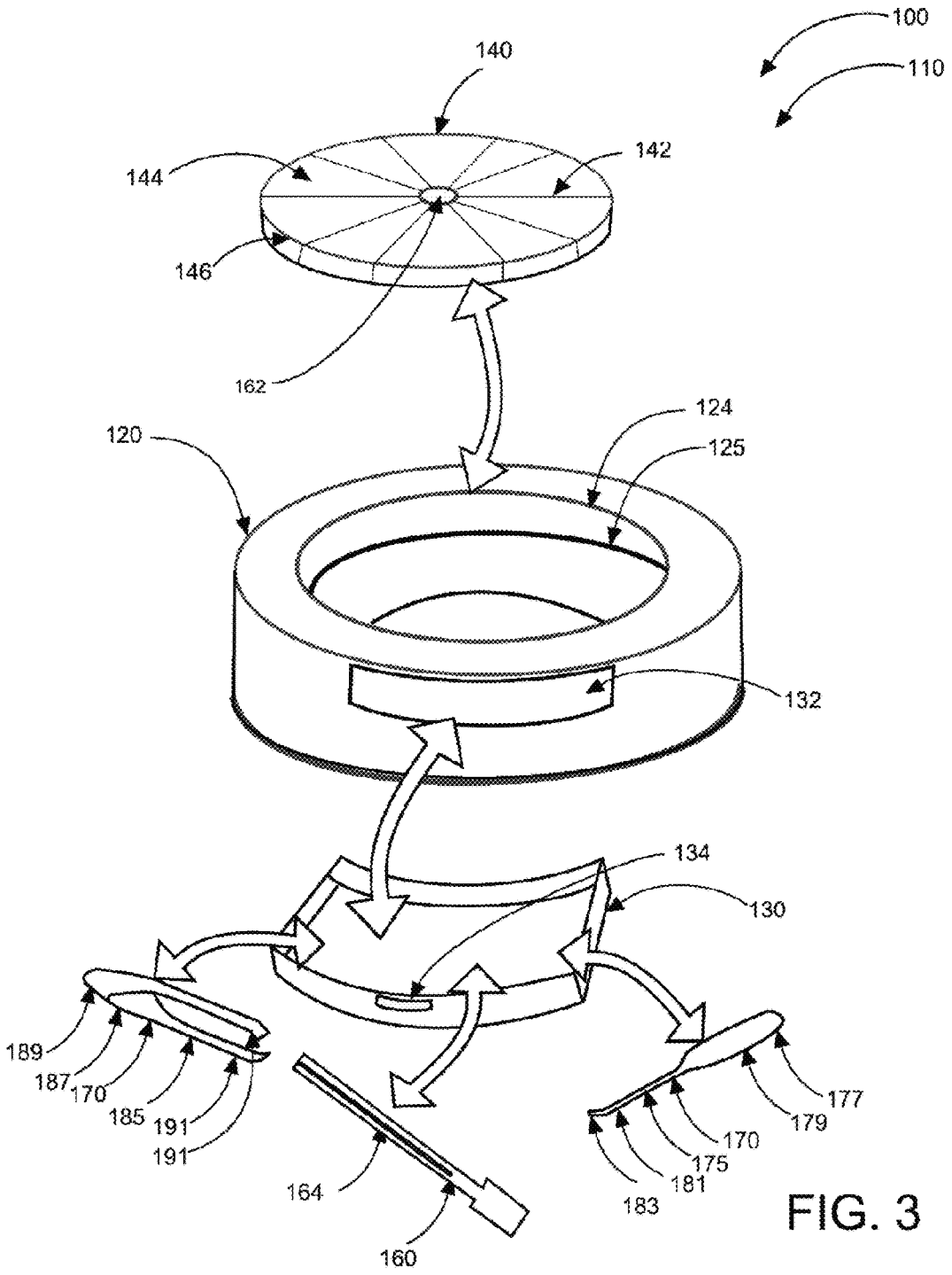
FIG. 3 is a perspective view illustrating a flower wheel system according to an embodiment of the present invention of FIG. 1.

Referring now to FIG. 3, a perspective view illustrating flower wheel system 100 according to an embodiment of the present invention of FIG. 1.

Drawer 130, useful for storing dowel 160 and pair of tools 170 is removably insertable into drawer-volume 132 of base 120. Drawer 130, comprising handle 134 for opening and closing drawer 130 via hand 107 of user 105, is sized to store dowel 160 and has sufficient storage clearance for pair of tools 170 when flower-wheel system 100 is not in use. Pair of tools 170 comprises ribbon-pick 175 comprised of bendable light-weight metal material and wire-pick 185 also comprised of light-weight metal material. In alternate embodiments ribbon-pick 175 and wire-pick 185 may comprise plastic materials and other materials suitable for manipulating ribbon-material 197 and wire-material 198 during creation of faux-flowers 104.

Ribbon-pick 175 comprises paddle-shape 177 having an overall length of approximately three and one-half inches with upper-part 179 measuring approximately one and one-half inches long and approximately one-half inch wide, and lower-section 181 comprising a length of approximately two inches, and approximately one-eighth of an inch wide, and terminating at pointed-tip 183. Ribbon-pick 175 is useful for manipulating ribbon-material 197 used for creating faux flowers 104 via pointed-tip 183 of lower-section 181 of ribbon-pick 175 in conjunction with dowel 160. Ribbon-pick 175 may also be manufactured having longer or shorter overall lengths.

Wire-pick 185 comprises tweezer-shape 187 having fulcrum-point 189 and two curved-levers 191 measuring approximately one-fourth of an inch wide. Each of curved-levers 191 extending out from fulcrum-point 189 approximately three inches in a biasing manner is useful for manipulating wire-material 198 used for creating faux flowers 104 via applying pressure to curved-levers 191 to grip wire-material 198 using wire-pick 185 in conjunction with dowel 160. Wire-pick 185 may be manufactured having longer or shorter overall lengths.

Floral wire-material 198 comprises different lengths as needed useful for reinforcing knotted ribbon-material 197 in vertical-slot 164 of dowel 160 by wrapping wire-material 198 around dowel 160 to secure the knotted ribbon-material 197 depending on type of faux flower user 105 is crafting. The floral wire-material 198 can also be used to secure ribbon-material 197 when user 105 measures ribbon-material 197 out from dowel 160 and folds ribbon-material 197 back to dowel 160 by wrapping around ribbon-material 197 depending on the type of faux flower user 105 is crafting.

Spinning-wheel 140 having dowel-insert 162, comprising durable material, fits onto protruding mount 125 in the center of circular-center-opening 124 of base 120 located in top 128 of base 120. Spinning-wheel 140, comprising a diameter of approximately four and one-half inches and a height of approximately one inch, is removably insertable onto protruding mount 125 in the center of circular-center-opening 124 of base 120. Spinning-wheel 140 may be constructed of any suitable material to allow free movement of spinning-wheel 140 in base 120 when flower-wheel-assembly 110 is in use. Spinning-wheel 140 further comprises plurality of fingertip-groves 142 equidistantly spaced around top-surface 144 of spinning-wheel 140. Spinning-wheel 140 may be manufactured in smaller or larger sizes to provide greater flexibility for user 105. Larger and smaller sizes of spinning-wheel 140 will affect the size of base 120 and of circulate-center-opening 124 of base 120.

Each of fingertip-groves 142, grooved into top-surface 144 of spinning-wheel 140, radiates out from dowel-insert 162 of spinning-wheel 140 to outer-edge 146 of spinning-wheel 140. Each of plurality of fingertip-grooves 142, measuring approximately three-sixteenths of an inch wide to accommodate fingertips 106 of user 105, are useful for manipulating spinning-wheel 140 when flower wheel system 100 is in use as user 105 turns spinning-wheel 140 alternately clockwise and counter-clockwise during creation of faux-flowers 104.

Dowel 160, having two insertion notches 165 extending out from lower-side 166 of dowel 160, each comprising a length of approximately three fourths of an inch. Dowel 160, comprises light weight metal material having an overall length of approximately four inches, is removably insertable into dowel-insert 162 of spinning-wheel 140 at an angle perpendicular to spinning-wheel 140 when flower wheel system 100 is in use. Dowel 160 is held in place via insertion notches 165 as dowel 160 turns clockwise or counter-clockwise as spinning-wheel 140 is being turned clockwise or alternately counter-clockwise. Dowel 160 further comprises a vertical-slot 164, comprising a length of approximately two and one-half inches useful for retaining a length of knotted/unknotted wire-edged-ribbon used to weave faux-flowers 104. Dowel 160 may be constructed of any suitable material able to be held in place to dowel-insert 162 during use and may be manufactured in smaller and larger sizes to use with the size of spinning-wheel 140.

Figure 4:
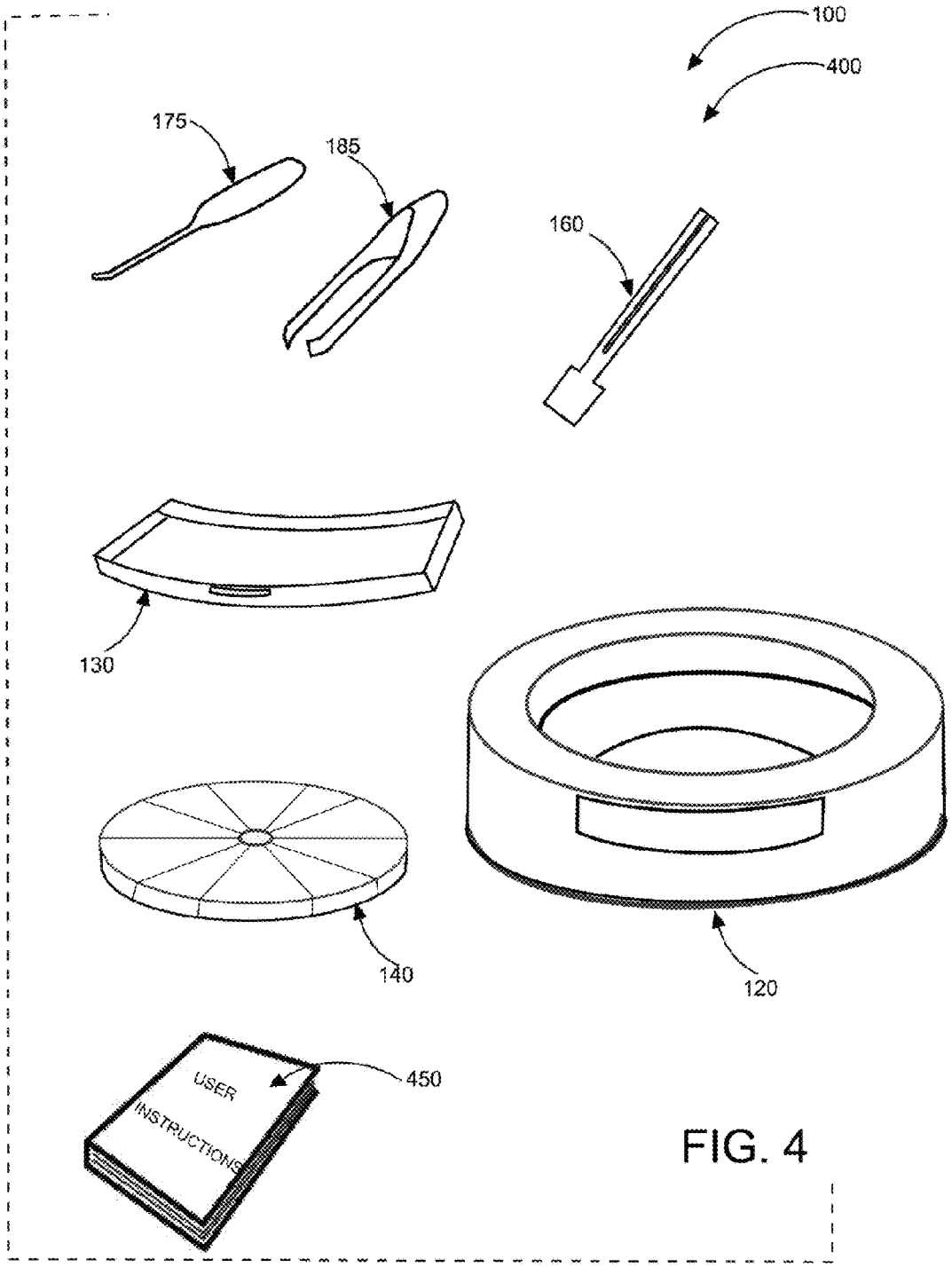
FIG. 4 shows a flower wheel system.

Referring now to FIG. 4, showing flower wheel system 100; flower wheel system 100 may be sold as kit 400 comprising the following parts: at least one base 120 at least one drawer 130; at least one spinning-wheel 140 having dowel-insert 162; at least one dowel 160; at least one ribbon-pick 175; at least one wire-pick 185; and at least one set of user instructions 450. The kit has instructions such that functional relationships are detailed in relation to the structure of the invention (such that the invention can be used, maintained, or the like in a preferred manner). Flower wheel system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different tool and base combinations, parts may be sold separately, etc., may be sufficient.

Figure 5:
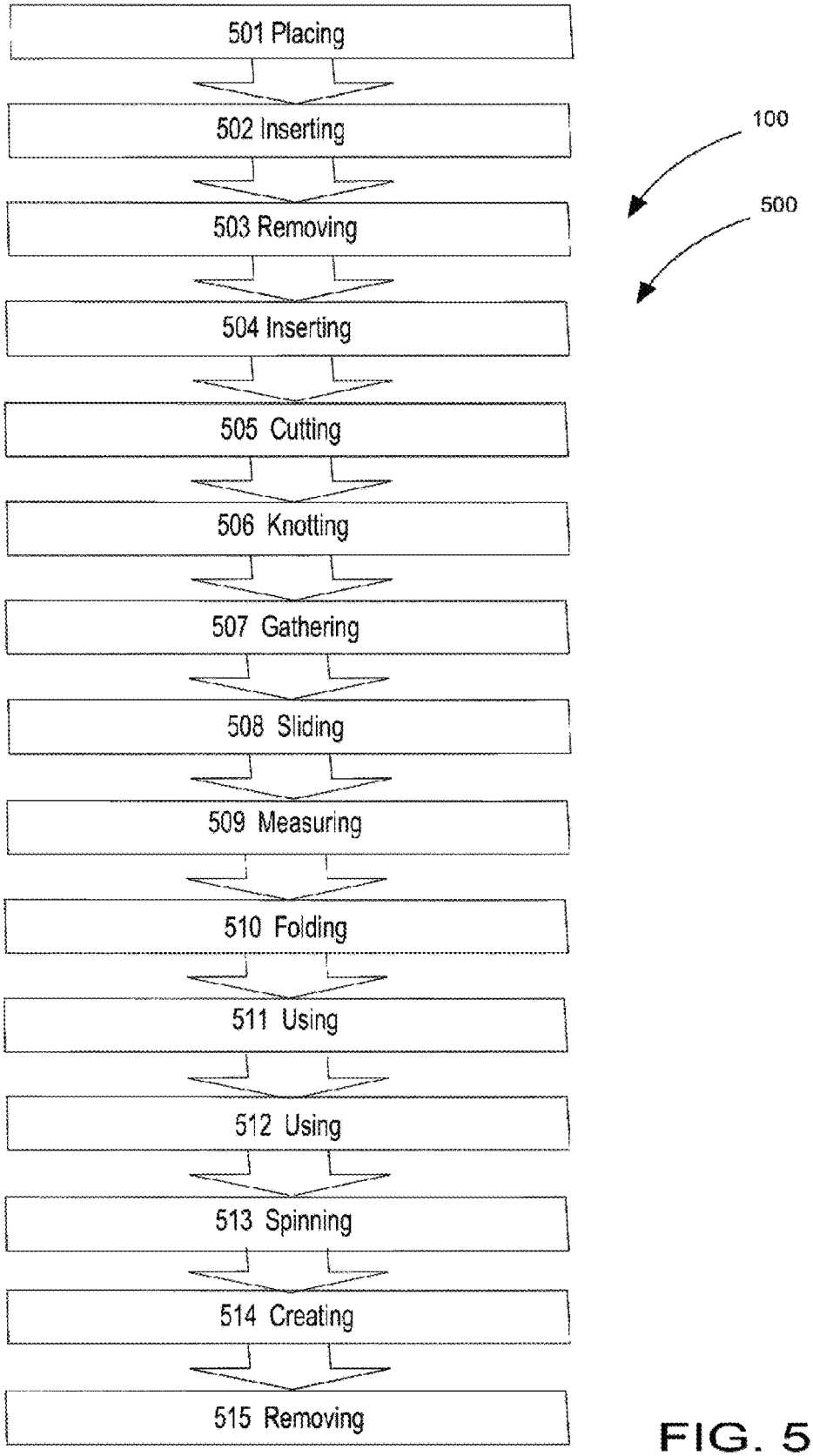
FIG. 5 is a flowchart illustrating a method of use for a flower wheel system according to an embodiment of the present invention of FIGS. 1-4.

Referring now to FIG. 5, a flowchart illustrating a method of use for flower wheel system 100 according to an embodiment of the present invention of FIGS. 1-4.

A method of use 500 for flower wheel system 100 may comprise the steps of: step one 501 placing base 120 on planer surface 102; step two 502 inserting spinning-wheel 140 onto protruding mount 125 in the center of circular-center-opening 124 of base 120; step three 503 removing dowel 160, wire-pick 185, and ribbon-pick 175 from drawer 130; step four 504 inserting dowel 160 via insertion-notches 165 into dowel-insert 162 of spinning-wheel 140; step five 505 cutting ribbon-material 197 to a desired length; step six 506 knotting a proximal end of ribbon-material 197; step seven 507 gathering ribbon-material 197 down to a knot; step eight 508 sliding knot over vertical-slot 164 of dowel 160 to secure ribbon-material 197 to flower-wheel-assembly 110; step nine 509 measuring ribbon-material 197 out from dowel 160; step ten 510 folding ribbon-material 197 back to dowel 160 and wrapping with floral wire to secure ribbon-material 197; step eleven 511 using wire-pick 185 with wire-material 198; step twelve 512 using ribbon-pick 175 with ribbon-material 197; step thirteen 513 spinning spinning-wheel 140 with fingertips 106 of user 105 in alternating clockwise or counter-clockwise directions as desired; step fourteen 514 creating faux-flowers 104 using wire-material 198 and ribbon-material 197; and step fifteen 515 removing faux-flowers 104 from flower-wheel-system 100.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A flower wheel system comprising:

a flower-wheel-assembly comprising:

a base;

a drawer; and a spinning-wheel having a dowel-insert;

a dowel; and at least one pair of tools;

wherein said drawer is removably insertable into a drawer-volume of said base, said drawer useful for storing said dowel and said at least one pair of tools;

wherein said spinning-wheel having said dowel-insert fits into a circular-center-opening of said base located in a top of said base;

wherein said dowel is removably insertable into said dowel-insert of said spinning-wheel when said flower wheel system is in use;

wherein said spinning-wheel comprises a plurality of fingertip-grooves useful for manipulating said spinning-wheel with fingertips of a user when said flower wheel system is in use; and wherein said user is able to use said flower wheel system to create faux flowers by removing said dowel and said at least one pair of tools from said drawer, insert said dowel into said dowel-insert and use said at least one pair of tools to fashion flower-making-materials into faux flowers via manipulating said spinning-wheel via said fingertip-grooves of said spinning-wheel with said fingertips of said user to turn said spinning-wheel in alternating clockwise and counter-clockwise directions, as desired.

2. The flower wheel system of claim 1 wherein said base comprises a flat-bottom-surface to rest evenly and stable on a planer surface.

3. The flower wheel system of claim 2 wherein said base comprises polished wooden material measuring two inches in height and seven and three quarters inches in diameter useful for providing stability for said flower-wheel-assembly when in use.

4. The flower wheel system of claim 2 wherein said flat-bottom-surface is covered with rubber material to provide gripping means and protection for said planer surface, said planer surface comprising a piece of furniture, when said flower-wheel-assembly is in use.

5. The flower wheel system of claim 1 wherein said drawer having a handle for opening and closing said drawer is sized to store said dowel and has sufficient storage clearance for said at least one pair of tools when said flower-wheel system is not in use.

6. The flower wheel system of claim 5 wherein said at least one pair of tools comprises a ribbon-pick comprised of bendable light-weight metal material and a wire-pick comprised of said light-weight metal material.

7. The flower wheel system of claim 6 wherein said ribbon-pick comprises a paddle-shape having an overall length of approximately three and one-half inches, said ribbon-pick having an upper-part measuring one and one-half inches long and one-half inch wide, and a lower-section comprising a length of two inches terminating at a pointed-tip.

8. The flower wheel system of claim 7 wherein said ribbon-pick is useful for manipulating ribbon-material used for creating said faux flowers via said pointed-tip of said lower-section of said ribbon-pick in conjunction with said dowel.

9. The flower wheel system of claim 6 wherein said wire-pick comprises a tweezer-shape having a fulcrum-point and two curved-levers, each of said curved-levers extending out from said fulcrum-point approximately three inches in a biasing manner.

10. The flower wheel system of claim 9 wherein said wire-pick is useful for manipulating wire-material used for creating said faux flowers via applying pressure to said curved-levers to grip said wire-material using said wire-pick in conjunction with said dowel.

11. The flower wheel system of claim 1 wherein said spinning-wheel comprising a diameter of four and one-half inches and a height of one inch is removably insertable into said circular-center-opening of said base.

12. The flower wheel system of claim 11 wherein said spinning-wheel comprises a plurality of said fingertip-grooves equidistantly spaced around a top-surface of said spinning-wheel.

13. The flower wheel system of claim 12 wherein each of said fingertip-grooves radiates from said dowel-insert of said spinning-wheel to an outer-edge of said spinning-wheel, said fingertip-grooves sized to accommodate fingertips of said user as said user turns said spinning-wheel alternately clockwise and counter-clockwise during creation of said faux-flowers.

14. The flower wheel system of claim 1 wherein said dowel, comprising a length of four inches, is removably insertable into said dowel-insert of said spinning-wheel at an angle perpendicular to said spinning-wheel, said dowel held in place via friction, said dowel turning clockwise and counter-clockwise as said spinning-wheel is being turned clockwise and alternately counter-clockwise.

15. The flower wheel system of claim 14 wherein said dowel comprises a vertical-slot, comprising a length of two and one-half inches, said vertical-slot useful for retaining a length of knotted/unknotted wire-edged-ribbon used to weave said faux-flowers.

16. The flower wheel system of claim 1 further comprising a kit including: at least one said base, at least one said drawer, at least one said spinning-wheel having said dowel-insert, at least one said dowel, at least one said ribbon-pick, at least one said wire-pick as said at least one pair of tools and a set of user instructions.

* * * * *